US009428963B1

(12) United States Patent
Smith et al.

(10) Patent No.: US 9,428,963 B1
(45) Date of Patent: Aug. 30, 2016

(54) BIDIRECTIONAL STABILIZER WITH IMPACT ARRESTORS AND BLADES WITH WRAP ANGLES

(71) Applicant: ALASKAN ENERGY RESOURCES, INC., Anchorage, AK (US)

(72) Inventors: Lee Morgan Smith, Anchorage, AK (US); Betty A. Eastup-Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

(21) Appl. No.: 15/078,991

(22) Filed: Mar. 23, 2016

Related U.S. Application Data

(63) Continuation-in-part of application No. 14/981,376, filed on Dec. 28, 2015, which is a continuation-in-part of application No. 14/802,104, filed on Jul. 17, 2015, now Pat. No. 9,297,209.

(60) Provisional application No. 62/069,456, filed on Oct. 28, 2014.

(51) Int. Cl.

| | |
|---|---|
| ***E21B 10/30*** | (2006.01) |
| ***E21B 7/28*** | (2006.01) |
| ***E21B 10/46*** | (2006.01) |
| ***E21B 17/10*** | (2006.01) |
| ***E21B 17/22*** | (2006.01) |

(52) U.S. Cl.
CPC ..... *E21B 10/30* (2013.01); *E21B 7/28* (2013.01); *E21B 10/46* (2013.01); *E21B 17/1078* (2013.01); *E21B 17/22* (2013.01)

(58) Field of Classification Search
CPC .... E21B 10/30; E21B 10/26; E21B 17/1078; E21B 17/22
See application file for complete search history.

(56) References Cited

U.S. PATENT DOCUMENTS

| | | | | |
|---|---|---|---|---|
| RE19,339 | E | 10/1934 | Vertson | |
| 3,268,274 | A * | 8/1966 | Ortloff | E21B 17/1078 175/325.4 |
| 3,285,678 | A | 11/1966 | Garrett et al. | |
| 3,322,217 | A | 5/1967 | Orr Cook | |
| 3,420,323 | A | 1/1969 | Owens | |
| 4,081,203 | A | 3/1978 | Fuller | |
| 4,231,437 | A | 11/1980 | Swersky et al. | |
| 4,277,869 | A | 7/1981 | Hartwell | |
| 4,385,669 | A | 5/1983 | Knutsen | |
| 4,610,316 | A | 9/1986 | Boaz | |

(Continued)

FOREIGN PATENT DOCUMENTS

WO 2013167954 A1 11/2013

*Primary Examiner* — Shane Bomar
(74) *Attorney, Agent, or Firm* — Buskop Law Group, PC; Wendy Buskop

(57) ABSTRACT

A bidirectional stabilizer, which reduces impact damage while rotating into and out of a wellbore. The bidirectional stabilizer can be coupled on a first end to a drill string and on a second end to a drill bit. The bidirectional stabilizer can have an annulus configured for maximum wellbore fluid flow. A cutting portion can be formed on a shaft with a plurality of blades between the first shaft end and the second shaft end. The plurality of blades of the cutting portion can be on a first plane and a plurality of cutting nodes can be on a second plane for smoothing a wellbore. The plurality of blades can have a wrap angle for forming a particle flow path between pairs of the plurality of blades configured with a line of sight parallel to the longitudinal axis.

20 Claims, 4 Drawing Sheets

(56) References Cited

U.S. PATENT DOCUMENTS

| | | | | |
|---|---|---|---|---|
| 4,664,206 | A | 5/1987 | Butler | |
| 5,330,016 | A | 7/1994 | Paske | |
| 6,695,080 | B2 * | 2/2004 | Presley | E21B 10/16 175/391 |
| 7,650,952 | B2 | 1/2010 | Evans et al. | |
| 8,162,081 | B2 | 4/2012 | Ballard et al. | |
| 8,607,900 | B1 | 12/2013 | Smith | |
| 9,145,746 | B1 | 9/2015 | Smith | |
| 9,151,118 | B2 | 10/2015 | Robson | |
| 9,151,119 | B1 | 10/2015 | Smith | |
| 2010/0051349 | A1 | 3/2010 | Ballard | |
| 2011/0253457 | A1 | 10/2011 | Shen | |
| 2012/0255786 | A1 | 10/2012 | Isenhour | |
| 2014/0202770 | A1 | 7/2014 | Zaki et al. | |
| 2014/0246247 | A1 | 9/2014 | Smith | |
| 2015/0275589 | A1 * | 10/2015 | Walker | E21B 17/1078 175/40 |

* cited by examiner

BIDIRECTIONAL STABILIZER WITH IMPACT ARRESTORS AND BLADES WITH WRAP ANGLES

CROSS REFERENCE TO RELATED APPLICATION

The current application is a Continuation in Part of U.S. Utility patent application Ser. No. 14/981,376 filed on Dec. 28, 2015, entitled "BIDIRECTIONAL STABILIZER WITH IMPACT ARRESTORS," which is a Continuation in Part of U.S. Utility patent application Ser. No. 14/802,104 filed on Jul. 17, 2015, entitled "BIDIRECTIONAL STABILIZER," which claims priority to and the benefit of U.S. Provisional Patent Application Ser. No. 62/069,456 filed on Oct. 28, 2014, entitled "BIDIRECTIONAL STABILIZER". These references are hereby incorporated in their entirety.

FIELD

The present embodiments generally relate to a bidirectional stabilizer with impact arrestors and blades with wrap angles.

BACKGROUND

A need exists for a bidirectional stabilizer for a drill string that can additionally smooth and can improve quality of a wellbore bidirectionally.

A need exists for a drilling rig with bidirectional stabilizer with impact arrestors and additional cutting elements.

The present embodiments meet these needs.

BRIEF DESCRIPTION OF THE DRAWINGS

The detailed description will be better understood in conjunction with the accompanying drawings as follows.

Figure 1:
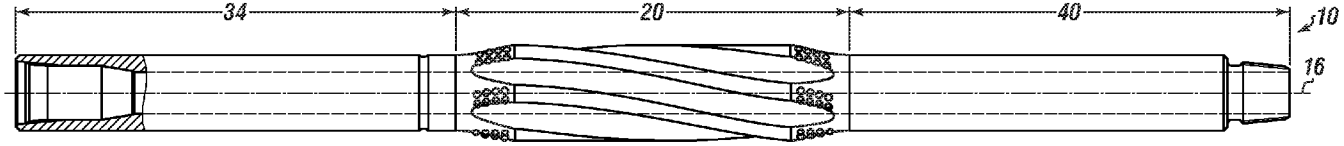
FIG. 1 depicts the side view of a bidirectional stabilizer according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relate to a bidirectional stabilizer with impact arrestors and blades with wrap angles.

The present embodiments generally relate to a bidirectional stabilizer with optional cutting elements and optional cutting inserts.

The present embodiments further relate to a drilling rig having a bidirectional stabilizer for use in a wellbore, wherein the bidirectional stabilizer can be coupled to the first end of a drill string and can be coupled on a second end to a drill bit.

The present embodiments further relate to a drilling rig having a bidirectional stabilizer with impact arrestors for use in a wellbore, wherein the bidirectional stabilizer can be coupled on the first end to a drill string and can be coupled on a second end to a drill bit.

The present embodiments relate to a drill string having one or more bidirectional stabilizers with impact arrestors for use in a wellbore. The bidirectional stabilizer can be coupled on a first end to a drill string and can be coupled on a second end to a drill bit.

The bidirectional stabilizer can reduce impact damage while rotating into and out of a wellbore.

The bidirectional stabilizer can have an annulus configured for maximum wellbore fluid flow.

In embodiments, the bidirectional stabilizer can have a cutting portion and be formed on a shaft with a plurality of helical blades between the first shaft end and the second shaft end. The plurality of helical blades of the cutting portion can be on a first plane.

The bidirectional stabilizer can have a plurality of cutting nodes on a second plane for smoothing a wellbore.

In embodiments, the bidirectional stabilizer can have the plurality of cutting nodes installed on at least a portion of at least one edge of the first cutting portion, on at least a portion of at least one edge of the second cutting portion, or on at least a portion of at least one edge of the first cutting portion and on at least one edge of the second cutting portion.

A plurality of impact arrestors can be used, wherein each impact arrestor can be mounted directly adjacent each cutting node of the plurality of cutting nodes. In embodiments, impact arrestors can be mounted at a right angle to a longitudinal axis of the bidirectional stabilizer.

In embodiments, each impact arrestor of the plurality of impact arrestors can be mounted in a location either directly adjacent each cutting node on the first cutting portion, directly adjacent each cutting node on the second cutting portion, or in both locations.

In embodiments, the impact arrestors can reduce torque variation, can provide consistent depth of cut, and can limit deviation tendencies, which can prevent damage to the drill bit or bottom hole assembly during bit drilling.

Also, embodiments can have a drilling rig with a bidirectional stabilizer for stabilizing a drill string while the drilling rig rotates drill pipe into and out of a wellbore. The embodiments can contain a drill string with at least one bidirectional stabilizer secured thereto. In embodiments, the drill string can support up to 3 bidirectional stabilizers per drill string and can engage bottom hole assemblies or drill bits.

The bidirectional stabilizer used by a drilling rig or the drill string can additionally increase a wellbore diameter, improve the quality of the wellbore while simultaneously stabilizing a drill string secured to a drilling rig, and ensure a longer life to the tools connected to the drill string.

In embodiments, the bidirectional stabilizer can be coupled on a first shaft end to the drill string and can be coupled on a second shaft end to a bottom hole assembly or other downhole equipment, such as any downhole equipment known in the industry.

In embodiments, the bidirectional stabilizer can be coupled on an end portion to the drill string and on a nose portion to the bottom hole assembly, and the bidirectional stabilizer can have a symmetrical configuration.

In embodiments, the end portion and the nose portion can range in length from 25 percent to 35 percent of a total length of the bidirectional stabilizer.

The bidirectional stabilizer can have an annulus configured for maximum wellbore fluid flow.

The bidirectional stabilizer cutting portion can be formed on a shaft with a plurality of helical blades between the first end and the second shaft end. The plurality of helical blades of the cutting portion can be on a first plane and a plurality of cutting nodes can be on a second plane, such as from 10 degrees to 30 degrees from the longitudinal axis of the bidirectional stabilizer.

In embodiments, at least one impact arrestor can be mounted in a location either directly adjacent each cutting node on the first cutting portion, directly adjacent each cutting node on the second cutting portion or both locations, or on both.

The impact arrestor can be used to avoid sudden torque spikes due to sudden changes in weight on a bit.

The term "cutting insert" as used herein can refer to a cutting material flush mounted on a portion of the bidirectional stabilizer.

The term "cutting nodes" as used herein can refer to a cutting material that extends from the surface of the cutting portion and can be made from polycrystalline diamond compacts and can extend further from the surface of the bidirectional stabilizer than the impact arrestors. In embodiments, cutting nodes can be installed in multiple rows, such as two rows of cutting nodes then two rows of impact arrestors on the same bidirectional stabilizer. In embodiments, rows can be offset from each other.

The term "diamond impregnated" as used herein can refer to a metal matrix with synthetic diamond particles or natural diamond particles embedded in the metal matrix or a metal matrix with both synthetic and natural diamond particles.

The term "polycrystalline diamond" as used herein can refer to a multilayer component with a first layer of synthetic diamond material and a second layer of a tungsten carbide substrate.

The term "wrap angle" as used herein can refer to total angular extent of full blade diameter, summed across all blades, such as up to 360 degrees, to allow for a clear line of sight.

In embodiments, two bidirectional stabilizers can be used on the same drill string, each with a different configuration, as an example, one bidirectional stabilizer can have 40 cutting nodes and the other bidirectional stabilizer can have 60 cutting nodes.

The embodiments can improve safety at the wellsite by reducing the number of trips into a well to solve the problem of drift in the diameter of the wellbore.

The embodiments can simultaneously provide a stable drill string while enabling reaming of a wellbore, which can protect the environment by reducing the number of trips by a bottom hole assembly out of a wellbore.

The embodiments can also minimize the possibility that wellbore fluid and other material from drilling a wellbore can explode out of the wellbore by minimizing the number of trips from the wellbore.

The embodiments can enable a wellbore to be smoothed out, which in turn can prevent damage to packers being sent down the wellbore.

The bidirectional stabilizer can connect to a drill string, to a bit coupled to the drill string, to a bottom hole assembly coupled to the drill string, or combinations thereof. The bidirectional stabilizer can be coupled to the drill string between the bottom hole assembly and tubulars that make up the drill string.

In embodiments, the bidirectional stabilizer can have an outer diameter from 3 inches to 26 inches.

The bidirectional stabilizer can have a cutting portion with a plurality of helical blades extending radially from the shaft.

The cutting portion can have a plurality of cutting inserts installed adjacent to a plurality of cutting nodes. In embodiments, the plurality of cutting inserts can be tungsten carbide inserts or other suitable materials used for drilling wellbores.

In embodiments, the plurality of cutting inserts can be in the shape of circles, cylinders, rectangles, ellipses, or other suitable shapes as required by a specific application.

In embodiments, each of the plurality of cutting inserts can be diamond cutting inserts, such as a diamond impregnated cutting insert, a polycrystalline diamond cutting insert or both the diamond impregnated cutting insert and the polycrystalline diamond cutting insert. In embodiments, the plurality of cutting inserts can be mounted either directly on a face of the plurality of blades or on at least one edge of the plurality of blades.

In embodiments, the plurality of cutting inserts can be disposed on the smooth blade surface of the plurality of helical blades without extending from a smooth blade surface more than 0.5 percent of a blade depth. In embodiments, the plurality of cutting inserts can be disposed on a smooth blade surface of the plurality of blades without extending from the smooth blade surface more than 0.5 percent of a blade depth.

In embodiments, the bidirectional stabilizer can have impact arrestors. The impact arrestors can be mounted on either the first cutting portion, the second cutting portion or both the first cutting portion and the second cutting portion to provide cutting when the cutting nodes wear down and impact control when the bidirectional stabilizer contacts to the wellbore.

Each impact arrestor can be made of at least one of: a tungsten carbide impact arrestor, a ceramic impact arrestor, a polycrystalline diamond impact arrestor or a diamond impregnated impact arrestor, combinations thereof, or any other material known in the industry that can be usable with the bidirectional stabilizer.

The bidirectional stabilizer can have a diamond enhanced hardfacing disposed on at least one of: a portion of each helical blade, each entire helical blade, or an area surrounding each impact arrestor.

In embodiments, from one impact arrestor to sixty impact arrestors can be used per bidirectional stabilizer. Each impact arrestor can be configured to simultaneously perform as a shock dampener and as an insert. Each of the impact arrestors can have any geometrical shape.

Each impact arrestor can be either flush mounted in one or both cutting portions or mounted to be slightly raised above a surface of the cutting portion.

In embodiments, each cutting insert can be mounted to a helical blade. The cutting inserts can be flush mounted.

In embodiments, the bidirectional stabilizer can include cutting inserts mounted on at least one: an edge of each helical blade, adjacent cutting nodes, and on a surface of each helical blade.

In embodiments, the cutting inserts can be aligned with a cutting node, an impact arrestor, cutting inserts, or combinations thereof.

The cutting inserts can be cylindrical in shape or of another shape, and can extend away from a surface of the helical blades, a surface of the cutting portions, or from both, if the cutting inserts are used on both surfaces.

In embodiments, the cutting inserts can have a rough rigid surface.

The cutting inserts can be made of a different material than that of the cutting nodes. In embodiments, the cutting inserts and the impact arrestors can give versatility to the bidirectional stabilizer to increase its ability to operate in many different types of rock with varying degrees of hardness that can be encountered during drilling.

The impact arrestors can protect cutting nodes by performing as shock disseminators.

Diamond enhanced hardfacing of any geometrical shape, can be applied to the helical blades and to the cutting portions of the bidirectional stabilizer.

The diamond enhanced hardfacing can be applied in between cutting inserts, impact arrestors, cutting inserts, or combinations thereof and can be applied across each helical blade or in between the helical blades.

Impact arrestors can be installed on the bidirectional stabilizer at an angle ranging from 30 degrees to 90 degrees from a longitudinal axis of the bidirectional stabilizer.

Cutting portions can be installed on the bidirectional stabilizer at an angle ranging from 20 degrees to 55 degrees from a longitudinal axis of the bidirectional stabilizer.

Cutting inserts can be installed on the bidirectional stabilizer at an angle ranging from 30 degrees to 90 degrees from a longitudinal axis of the bidirectional stabilizer.

In embodiments, a first portion of the impact arrestors can be oriented at a different angle from a second portion of the impact arrestors on the same tool.

In embodiments, a first portion of the cutting inserts can be oriented at a different angle from a second portion of cutting inserts on the same tool.

The bidirectional stabilizer can have a symmetrical configuration.

Turning now to the Figures, FIG. 1 depicts a side view of a bidirectional stabilizer according to one or more embodiments.

The bidirectional stabilizer 10 can include a shaft with a longitudinal axis 16. The longitudinal axis 16 can be the axis of rotation of the shaft. The bidirectional stabilizer can be a centric bidirectional stabilizer that can allow the axis of rotation of the shaft to be the same as the center of axis of rotation for the drill pipe or tubulars forming a drill string.

In embodiments, the bidirectional stabilizer can be modular.

In embodiments, the bidirectional stabilizer 10 can be made from either a high strength alloy or a non-magnetic material.

The bidirectional stabilizer 10 can have a nose portion 40, an end portion 34 and a cutting portion 20. The end portion 34 can have a stab end for receiving a stab from the drill string. The nose portion 40 can engage a bottom hole assembly, another drill pipe or tubular of a drill string, a drill bit, a mechanism to measure drilling equipment, or rotary steering downhole drilling motors.

In embodiments, the nose portion 40 can have an outer diameter ranging from 3 inches to 36 inches and an inner diameter that can be identical or substantially equivalent to the end portion. The inner diameter can be from 1 inch to 3 inches.

In other embodiments, the nose portion and the end portion can have the same inner diameters for flow through of wellbore fluid.

In embodiments, the cutting portion 20 can have an outer diameter that can be from one percent to twenty-five percent larger in diameter than the outer diameter of the nose portion or the outer diameter of the end portion.

In embodiments, the outer diameter of the cutting portion 20 can be in a plane different from the outer diameter of the nose portion 40 or the outer diameter of the end portion 34.

The cutting portion 20 can be between the nose portion 40 and the end portion 34.

Figure 2:
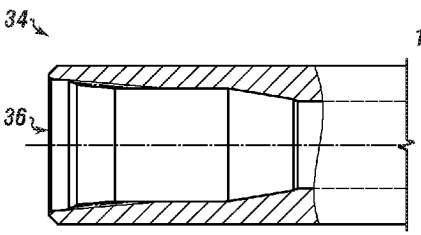
FIG. 2 depicts an end portion of the bidirectional stabilizer according to one or more embodiments.

FIG. 2 depicts an end portion of the bidirectional stabilizer according to one or more embodiments.

The end portion 34 can have a stab end 36, which can be configured to receive components from the bottom hole assembly, such as a collar or the like, made of nickel alloys, primarily composed of nickel and copper, with small amounts of iron, manganese, carbon, or silicon.

Figure 3:
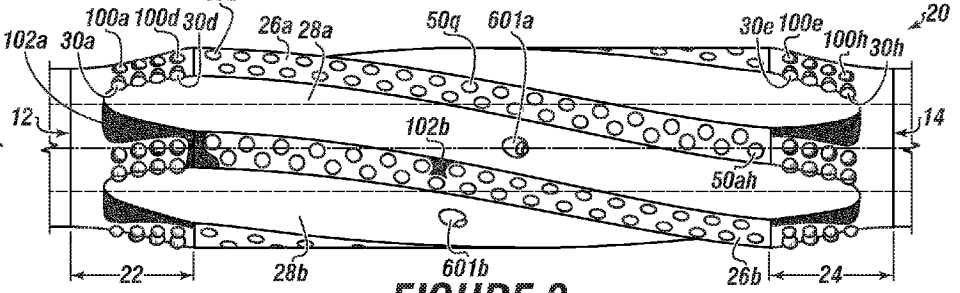
FIG. 3 depicts a cutting portion of the bidirectional stabilizer according to one or more embodiments.

FIG. 3 depicts a cutting portion of the bidirectional stabilizer according to one or more embodiments.

The cutting portion 20 can have a first shaft end 12 and a second shaft end 14. In embodiments, the first shaft end and the second shaft end can be threaded.

An annulus can be formed longitudinally through the first shaft end 12 and the second shaft end 14. The annulus can be configured for maximum wellbore fluid flow.

A first cutting portion 22 can extend at a first cutting angle from the first shaft end 12. The first cutting angle can range from 10 degrees to 30 degrees from the longitudinal axis, forming a slightly larger outer diameter for the first cutting portion 22 as the first cutting portion 22 extends away from the first shaft end 12.

A second cutting portion 24 can extend at a second cutting angle from the second shaft end 14. The second cutting angle can range from 10 degrees to 30 degrees from the longitudinal axis, forming a slightly larger outer diameter for the second cutting portion as the second cutting portion extends away from the second shaft end 14.

A plurality of impact arrestors 100*a*-100*d* are shown on the first cutting portion 22 and a plurality of impact arrestors 100*e*-100*h* are shown on the second cutting portion 24.

In embodiments, the plurality of impact arrestors can be mounted directly adjacent a cutting node on the first cutting portion 22, the second cutting portion 24 or both the first cutting portion and the second cutting portion.

A plurality of cutting nodes 30*a*-30*d* are shown on the first cutting portion 22 and a plurality of cutting nodes 30*e*-30*h* are shown on the second cutting portion 24.

The plurality of cutting nodes 30*a*-30*h* can have a diameter ranging from ⅜ of an inch to 1 inch. In embodiment, the plurality of cutting nodes can extend from 0.1 inch to 0.5 inches from the surface of the first and second cutting portions. In embodiments, the plurality of cutting nodes can be polycrystalline diamond compacts or other suitable materials used for drilling wellbores.

A plurality of helical blades 26*a* and 26*b* can extend identically from the first shaft end, the second shaft end, or both in a flat plane for enhanced stability of the drill string, and can reducing wobble.

In embodiments, the plurality of helical blades 26*a* and 26*b* can be longitudinally connected between the first and second cutting portions in a plane parallel to the longitudinal axis.

In embodiments, a plurality of cutting inserts 50*a*-50*ah* can be mounted on a surface of the plurality of helical blades 26*a* and 26*b*. In embodiments, the plurality of cutting inserts 50*a*-50*ah* can be mounted on an edge of each helical blade 26*a* and 26*b*, cutting portions adjacent the plurality of cutting nodes 30*a*-30*h*, a surface of each helical blade 26*a* and 26*b*, or combinations thereof.

In embodiments, a plurality of flutes 28*a* and 28*b* can be used, wherein each flute of the plurality of flutes 28*a* and 28*b* can be formed between each pair of helical blades of the plurality of helical blades 26*a* and 26*b*. Each flute of the plurality of flutes 28*a* and 28*b* can be tapered on each end. The depth of each flute of the plurality of flutes 28*a* and 28*b* can be from 10 percent to 50 percent of the outer diameter of the overall bidirectional stabilizer.

For this type of drilling application, all of the drilling components can be made up with a high strength or premium connection. The bidirectional stabilizer can use a unique flute depth while still providing a strong high strength premium connection.

The flute depth can be as deep as possible to ensure a maximum flow of drill cuttings, without clogging, while simultaneously providing a high strength premium connection.

Each flute 28*a* can be formed between a pair of helical blades 26*a* and 26*b* and flute 28*b* can be formed between a different pair of helical blades 26*a* and 26*b*.

In embodiments, at least one diamond enhanced hardfacing 102*a* and 102*b* can be disposed on at least a portion of one of the plurality of helical blades. In embodiments, the at least one diamond enhanced hardfacing 102*a* and 102*b* can be disposed on each helical blade 26*a*. In embodiments, the at least one diamond enhanced hardfacing 102*a* can completely cover each helical blade 26*a*. In embodiments, the at least one diamond enhanced hardfacing 102*a* and 102*b* can cover portions of the helical blades 26*a* and 26*b*. In additional embodiments, the at least one diamond enhanced hardfacing 102*a* and 102*b* can be arranged in patterns, such as helical patterns to more quickly cut the wellbore in the direction the bidirectional stabilizer is being rotated.

In embodiments, at least one nozzle 601*a* and 601*b* can be used for diverting a portion of drilling fluid from the annulus to the plurality of flutes 28*a* and 28*b* at an angle from 0 degrees to 90 degrees from the longitudinal axis pointing downhole toward the second cutting portion.

The at least one nozzle 601*a* and 601*b* can be welded or otherwise fastened into the trough of a flute below the helical blade 26*a* and 26*b* smooth surface.

In embodiments, the bidirectional stabilizer can have from at least one nozzle to four nozzles. In embodiments, at least one nozzle can be mounted in each flute, which can divert a portion of drilling fluid from the annulus to the plurality of flutes at an angle from 0 degree to 90 degrees from the longitudinal axis In embodiments, each flute can have a plurality of nozzles.

Figure 4:
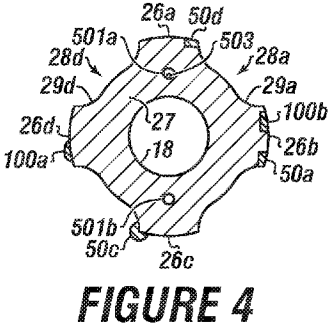
FIG. 4 depicts a cut view of the cutting portion according to one or more embodiments.

FIG. 4 depicts a cut view of the cutting portion according to one or more embodiments.

The bidirectional stabilizer can have a shaft 27 connected between the first shaft end and the second shaft end.

The plurality of helical blades 26*a*-26*d* can be formed on the outer surface of the shaft.27.

The shaft 27 can have an outer diameter with the first shaft end and the second shaft end. In embodiments, the shaft can then be centered around an annulus 18 formed longitudinally through the shaft in which the annulus is configured for maximum wellbore fluid flow.

In embodiments, when the plurality of helical blades 26*a*-26*d* are used, the plurality of helical blades 26*a*-26*d* can have identical sizes. Additionally, in embodiments, the plurality of helical blades 26*a*-26*d* can have different thicknesses.

In other embodiments, the bidirectional stabilizer does not need the plurality of helical blades to operate.

The plurality of flutes 28*a*-28*d* can be located between pairs of the plurality of helical blades 26*a*-26*d*. The plurality of flutes can have flute troughs 29*a*-29*d*.

In embodiments, the plurality of impact arrestors 100*a* and 100*b* can be used. Impact arrestor 100*a* is shown extending from the surface of the helical blade. Impact arrestor 100*b* is shown embedded in the helical blade in a flush fit, which can form a smooth surface with the helical blade.

The impact arrestor 100*b* can be flush mounted in the cutting portion, and the impact arrestor 100*a* can be slightly raised above a surface of the cutting portion. It should be noted that the raised impact arrestors can have a height less than a height of the cutting nodes.

In embodiments, from one impact arrestor to sixty impact arrestors can be used. In embodiments, each impact arrestor can be configured to simultaneously perform as a shock dampener and as a cutting insert.

In embodiments, each impact arrestor can be cylindrical in shape and identical to the diameter of the cutting nodes. In embodiments, each impact arrestor can extend from the surface less than the cutting nodes, such as ten percent less than the adjacent cutting nodes.

In embodiments, the plurality of cutting inserts 50*a*-50*d* can be mounted on an edge of the helical blades 28*a*-28*d*.

In embodiments, from one cutting insert to sixty cutting inserts can be used.

In embodiments, the cutting portion can have at least one communication conduit 501*a* for flowing well fluid, which can include but is not limited to such substances as drilling mud, down the bidirectional stabilizer in a flow direction parallel to fluid flowing through the annulus 18.

In embodiments, the communication conduit 501*a* can be used for flowing well fluid in the same direction as fluid flowing the annulus.

In embodiments, a communication wire 503 can also be disposed or installed in the communication conduit 501*a* to communicate with bottom hole assemblies or other downhole equipment.

In embodiments, the communication conduit 501*a* can be a conduit that is offset from the annulus 18.

In embodiments, the communication conduit 501*a* can be separated and without fluid communication with the annulus 18. In embodiments, the communication conduit 501*a* can be fluidly connected to the annulus 18.

In embodiments, two communication conduits 501*a* and 501*b* can be used on opposite sides of the annulus 18 to provide a balanced tool during rotation.

In embodiments, the communication conduit can flow from two percent to twenty percent of a volume of fluid that is flowing through the annulus.

Figure 5:
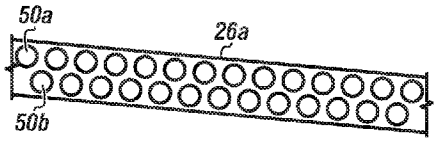
FIG. 5 depicts a detailed view of the surface of a blade according to one or more embodiments.

FIG. 5 depicts a detailed view of a surface of a helical blade of the plurality of helical blades according to one or more embodiments.

In embodiments, the blade of the plurality of helical blades 26*a* can have a plurality of cutting inserts 50*a* and 50*b* disposed thereon. The plurality of cutting inserts can be circular in shape.

In embodiments, the plurality of cutting inserts 50*a* and 50*b* can be arranged on each helical blade 26*a* of the plurality of helical blades in an alternating arrangement. While the plurality of cutting inserts are shown as circular, other embodiments can make use of any suitable shape for the plurality of cutting inserts.

The plurality of cutting inserts can range in diameter, if circular from ⅛ inch to 1 inch. In embodiments, up to 150 cutting inserts can be installed on each helical blade of the plurality of helical blades.

A portion of the plurality of cutting inserts 50*a* and 50*b* can be installed adjacent the plurality of cutting nodes at the ends of the helical blades of the plurality of helical blades.

In embodiments, the plurality of cutting inserts can range from fifteen cutting inserts per inch to fifty cutting inserts per inch.

The plurality of cutting inserts can be rectangular in shape and arranged in an alternating configuration on the blade of the plurality of helical blades.

In embodiments, one or all of the helical blades can have a plurality of cutting inserts 50*a* and 50*b* disposed on the smooth blade surface in a flush mount without extending from the surface.

Figure 6:
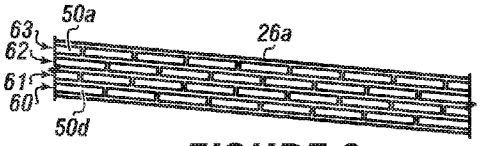
FIG. 6 depicts a detailed view of the surface of a blade according to one or more embodiments.

FIG. 6 depicts a detailed view of a surface of a helical blade of the plurality of helical blades according to one or more embodiments.

The blade of the plurality of helical blades 26*a* can have a plurality of cutting inserts 50*a*-50*d* disposed thereon. The plurality of cutting inserts can be rectangular in shape and configured in an alternating arrangement, such as, but not limited to, a trapezoid shape, another polygon shape, a triangle shape, and a square sharp.

The plurality of cutting inserts 50*a*-50*d* can be arranged in parallel rows 60, 61, 62 and 63 with a first row 60 offset from a second row 61. In embodiments, the cutting inserts can be disposed in offset rows. In embodiments, the cutting inserts can be arranged on the smooth blade surface in clusters, or groups of cutting nodes separated from other groups. In embodiments, the cutting inserts can be spaced irregularly from each other.

In embodiments, the plurality of cutting inserts can have a shape other than a circular shape, such as a rectangular shape, and be arranged in an alternating configuration on the blade of the plurality of helical blades.

In embodiments, the plurality of cutting inserts can be installed on at least one edge of at least one helical blade of the plurality of helical blades. In embodiments, at least one cutting insert to thirty cutting inserts can be used per helical blade.

In embodiments, the bidirectional stabilizer excluding the plurality of cutting nodes can be an integral one piece bidirectional stabilizer, which can be formed from a single piece of metal.

In embodiments, the plurality of helical blades can be formed from a material harder than the material used to form the first shaft end, the shaft and the second shaft end.

In embodiments, the plurality of helical blades can be pretreated with nitride or another chemical or process to improve hardness and create a more durable bidirectional stabilizer.

Figure 7:
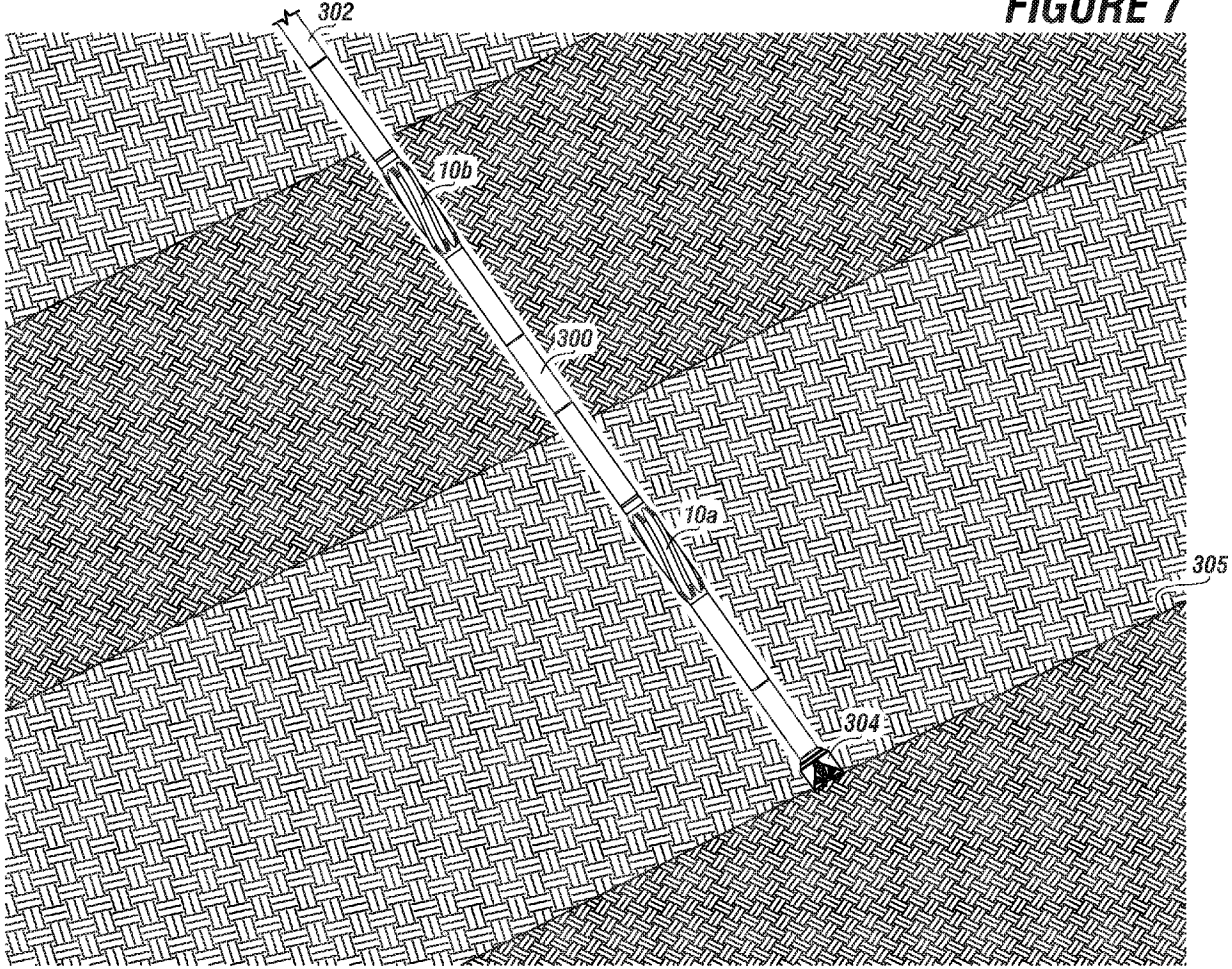
FIG. 7 shows a drill string in the wellbore according to one or more embodiments.

FIG. 7 shows a drill string in the wellbore according to one or more embodiments.

The e drill string can have at least one bidirectional stabilizer 10*a*, which can be mounted between a bottom hole assembly 304 and a first drill pipe segment 300.

In embodiment, the drill string is shown with an additional bidirectional stabilizer 10*b*, which can be mounted between the first drill pipe segment 300 and a second drill pipe segment 302.

The drill string is shown in the wellbore surrounding a formation 305.

In embodiments, the bidirectional stabilizer can be a sixty inch long bidirectional stabilizer, a fifteen inch long bidirectional stabilizer, or a twenty inch long bidirectional stabilizer. When the bidirectional stabilizer is of a short length, the bidirectional stabilizer can be installed every 100 feet of drill pipe. When such short versions of the bidirectional stabilizer are used, from 3 bidirectional stabilizers to 20 bidirectional stabilizers can be used, and a few can even be stacked through the bottom hole assembly.

With a slightly larger outer diameter, the formation can rub on the bidirectional stabilizer and not on the drill pipe.

In long wells, ranging from one mile to twenty miles in length, the bidirectional stabilizer can simultaneously perform as a sacrificial node while centralizing the drill string and protecting the more expensive drill pipe.

Figure 8:
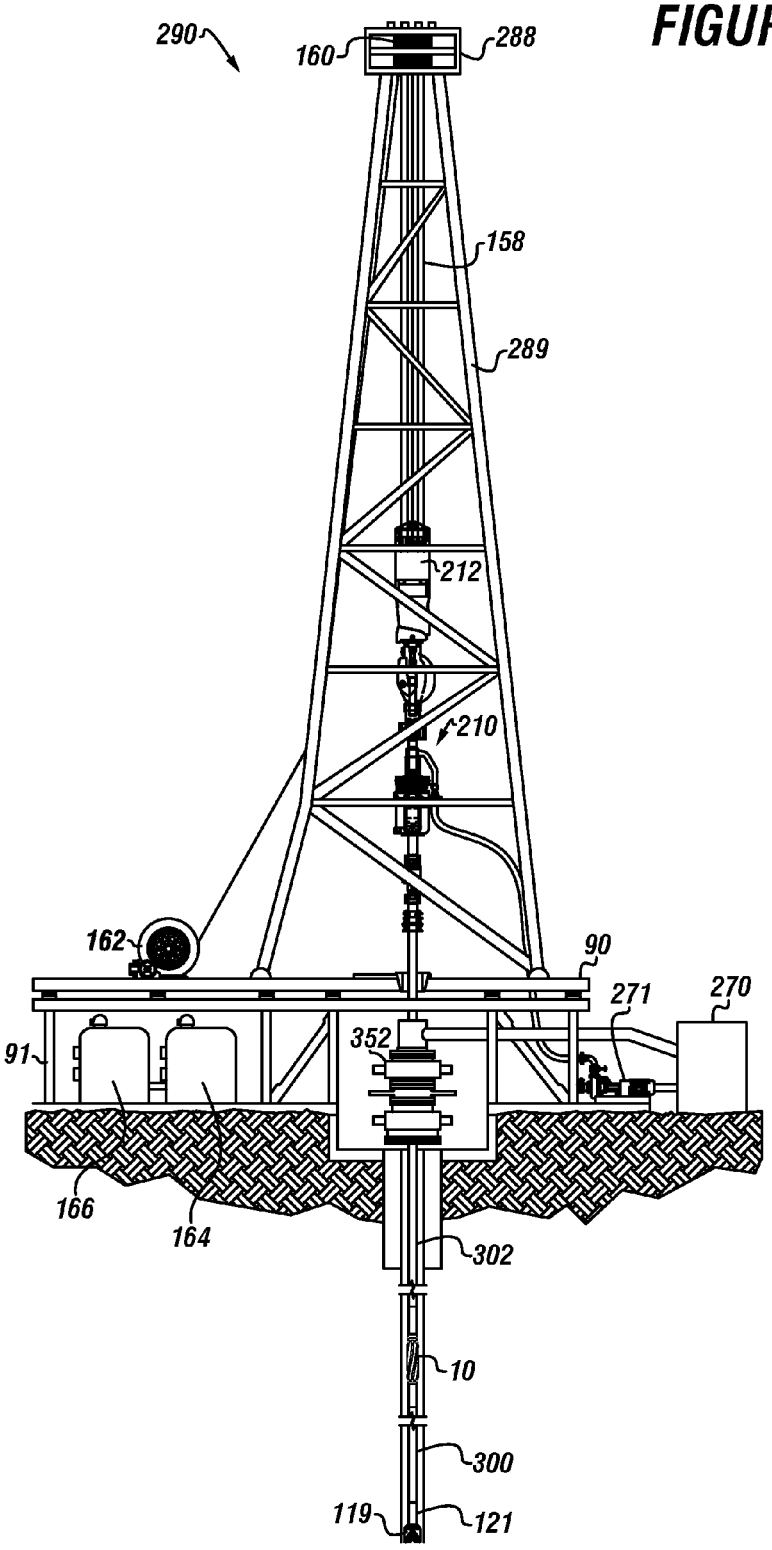
FIG. 8 depicts a drilling rig with the bidirectional stabilizer according to one or more embodiments.

FIG. 8 shows a drilling rig with the bidirectional stabilizer according to one or more embodiments.

The bidirectional stabilizer 10 can be configured to simultaneously smooth a wellbore, centralize the downhole components from wear and damage and flow drilling fluid to at least one downhole component or at least one operating component while allowing wellbore fluid to flow to a surface unimpeded.

The drilling rig 290 can have a tower 289 and a crown 288 with a plurality of sheaves 160. In embodiments, the tower can be a derrick.

The tower can have a rig floor 90 and a rig floor substructure 91.

The drilling rig 290 can have a drawworks 162 connected with a drawworks motor 164, which can be connected to a power supply 166.

A cable 158 can extend from the drawworks 162 through the plurality of sheaves 160 over the crown 288. A lifting block 212 can be connected to the cable 158.

A hydraulic pump 271 can be fluidly connected to a tank 270 to allow flowing fluid into the wellbore as drill pipe is turned into the wellbore.

A rotating means 210 can be used for turning drill pipe into the wellbore. The rotating means 210 can be a top drive, a power swivel mounted to the lifting block, or another device known in the industry that can be used for turning drill pipe.

In embodiments, the rotating means can be a rotary table mounted to the rig floor for rotating drill pipe into a wellbore.

A blowout preventer 352 can be connected between the rotating means and the wellbore for receiving drill pipe.

The bidirectional stabilizer 10 can be mounted between the first drill pipe segment 300 and the second drill pipe segment 302.

A drill bit 119 is shown attached to the first drill pipe segment 300 and a bottom hole assembly 121 is shown connected between the drill bit 119 and the first drill pipe segment 300.

The bidirectional stabilizer can be mounted in drill pipe segments as the drill pipe is run into the wellbore. This can allow the drilling rig to save measurement while drilling equipment and bottom hole components as they are lowered downhole.

Figure 10:
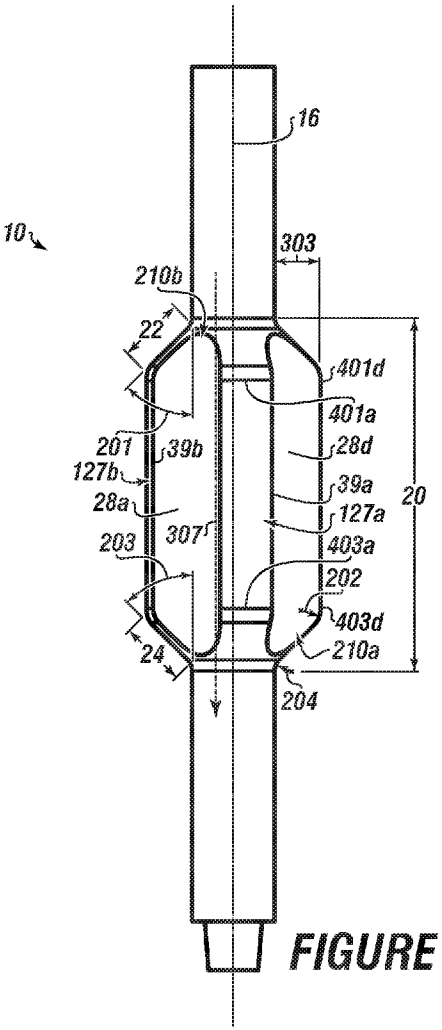
FIG. 10 shows a bidirectional stabilizer with an uninterrupted line of sight through the flutes between the blades for fluid flow according to one or more embodiments.
Figure 9:
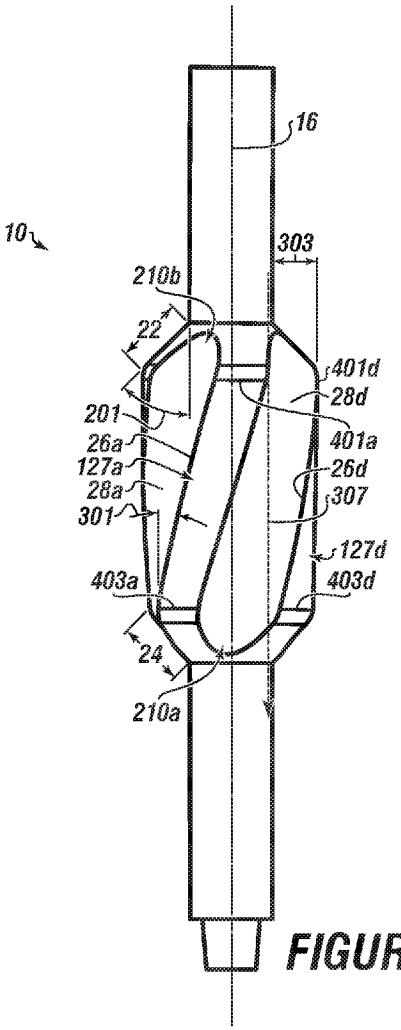
FIG. 9 shows a bidirectional stabilizer with a slightly interrupted line of sight through the flutes between the blades for fluid flow according to one or more embodiments.

FIG. 9 shows a bidirectional stabilizer with a slightly interrupted line of sight through the plurality of flutes between the plurality of blades for fluid flow. FIG. 10 shows a bidirectional stabilizer with an uninterrupted line of sight through the flutes between the blades for fluid flow.

The bidirectional stabilizer 10 can have the first cutting portion 22, which can extend at a first cutting angle 201 to a first apex 401*a* from the first shaft end, and the second cutting portion 24, which can extend at a second cutting angle 203 to a second apex 403*a* from the second shaft end. In embodiments, the second cutting portion can form a slightly larger outer diameter for the second cutting portion as the second cutting portion extends away from the second shaft end.

Each helical blade can start at each first apex 401*a*-401*d* and each helical blade can end at each second apex 403*a*-403*d*. The first apex and the second apex can be a rounded surface, but is not limited to a certain shape.

In embodiments, the first cutting portion and the second cutting portion can be installed at the first cutting angle 201 and the second cuttings angle 203, wherein the first and second cutting angles can range from 20 degrees to 55 degrees from the longitudinal axis 16 of the bidirectional stabilizer 10.

The plurality of flutes 28*a* and 28*b* can create a first area for fluid flow, referred to herein as a first bypass area 210*a*, which can be sized to be greater than or equal to thirty-five percent of a bit diameter for bits having an outer diameter of 10 inches ⅝ of an inch or greater, and a second area for fluid flow, referred to herein as a second bypass area 210*b*, which can be greater than or equal to twenty-five percent of a bit diameter for bits having an outer diameter less than 10 and ⅝ of an inch. Each bypass area can be formed around the longitudinal axis 16 of the bidirectional stabilizer 10.

The cutting portion 20 forms a transition radius shown as an inner radius 204 of the cutting portion, wherein the inner radius 204 of the cutting portion 20 can be greater than or equal to ⅛ of an inch of each blade depth 303 as measured from the flute trough to reduce stress on the bottom hole assembly of the drill string to which the bidirectional stabilizer is secured.

The cutting portion 20 forms a transition radius shown as an outer radius 202 of the cutting portion, wherein the outer radius 202 of the cutting portion 20 can be greater than or equal to ¼ of an inch of each blade depth 303 as measured from the flute trough to reduce hang-up in a wellbore during operation.

FIG. 9 shows an embodiment, wherein the plurality of helical blades 26*a*-26*d* can be integrally connected between the first cutting portion 22 and the second cutting portion 24, wherein each helical blade can have an identical length.

Each helical blade can have a smooth blade surface 127*a*-127*d* with a wrap angle 301 forming a particle flow path between pairs of helical blades without intersecting more than thirty percent of any one helical blade and configured with a line of sight 307 parallel to the longitudinal axis 16.

FIG. 10 shows an embodiment, wherein a plurality of blades 39*a* and 39*b* can be integrally connected between the first cutting portion 22 and the second cutting portion 24, wherein each blade can have an identical length.

Each blade can have a smooth blade surface 127*a* and 127*b* with a line of sight 307 parallel to the longitudinal axis 16. In embodiments, the plurality of blades can be straight blades.

While these embodiments have been described with emphasis on the embodiments, it should be understood that within the scope of the appended claims, the embodiments might be practiced other than as specifically described herein.

What is claimed is:

1. A bidirectional stabilizer for use in a wellbore comprising:

a) a shaft centered around a longitudinal axis;

b) an annulus formed longitudinally through the shaft, wherein the annulus is configured for maximum wellbore fluid flow; and c) a cutting portion extending from the shaft, the cutting portion comprising:

i) a first cutting portion extending at a first cutting angle to a first apex from a first shaft end;

ii) a second cutting portion extending at a second cutting angle to a second apex from a second shaft end, the second cutting portion forming a slightly larger outer diameter as the second cutting portion extends away from the second shaft end, wherein the first cutting portion and the second cutting portion are installed at the first cutting angle and the second cutting angle ranging from 20 degrees to 55 degrees from the longitudinal axis of the bidirectional stabilizer;

iii) a plurality of helical blades integrally connected between the first cutting portion and the second cutting portion, each helical blade having an identical length, each helical blade comprising a smooth blade surface with a wrap angle forming a particle flow path between pairs of helical blades without intersecting more than thirty percent of any one helical blade and configured with a line of sight parallel to the longitudinal axis;

iv) an outer radius of the cutting portion greater than or equal to ¼ of an inch of a blade depth as measured from a flute trough to reduce hang-up in a wellbore;

v) an inner radius of the cutting portion greater than or equal to ⅛ of an inch of the blade depth as measured from the flute trough to reduce stress on a bottom hole assembly of a drill string to which the bidirectional stabilizer is secured;

vi) a plurality of flutes formed between pairs of the plurality of helical blades, the plurality of flutes configured with a first bypass area greater than or equal to thirty-five percent of a bit diameter for bits having an outer diameter of 10 and ⅝ inches or greater or a second bypass area greater than or equal to twenty five percent of a bit diameter for bits having an outer diameter less than 10 and ⅝ inches;

vii) a plurality of cutting nodes installed on at least a portion of at least one edge of the first cutting portion, on at least a portion of at least one edge of the second cutting portion, or on at least a portion of at least one edge of the first cutting portion and the second cutting portion; and viii) a plurality of impact arrestors mounted in a location either directly adjacent each cutting node on the first cutting portion, directly adjacent each cutting node on the second cutting portion, or in both locations; and wherein the bidirectional stabilizer couples on an end portion to the drill string and on a nose portion to the bottom hole assembly simultaneously, with the bidirectional stabilizer having a symmetrical configuration.

2. The bidirectional stabilizer of claim 1, wherein the plurality of impact arrestors comprises at least one of: a tungsten carbide arrestor, a ceramic impact arrestor, a polycrystalline diamond impact arrestor, and a diamond impregnated impact arrestor.

3. The bidirectional stabilizer of claim 1, comprising a plurality of cutting inserts comprising at least one of: a diamond impregnated cutting insert and a polycrystalline diamond cutting insert, and wherein the plurality of cutting inserts are mounted either directly on a face of the plurality of helical blades or on at least one edge of the plurality of helical blades.

4. The bidirectional stabilizer of claim 1, comprising at least one diamond enhanced hardfacing disposed on at least one of: a portion of each helical blade, an entire helical blade, and an area surrounding each impact arrestor.

5. The bidirectional stabilizer of claim 1, comprising from 1 impact arrestor to 60 impact arrestors per bidirectional stabilizer, each impact arrestor configured to simultaneously perform as a shock dampener and as a cutting insert.

6. The bidirectional stabilizer of claim 1, wherein each impact arrestor is either flush mounted in the cutting portion or slightly raised above a surface of the cutting portion or the plurality of helical blades and extend from the surface less than the plurality of cutting nodes extend from the surface.

7. The bidirectional stabilizer of claim 1, further comprising a plurality of cutting inserts mounted on at least one of: an edge of each helical blade, cutting portions adjacent the plurality of cutting nodes, and a surface of each helical blade and wherein the plurality of cutting inserts are disposed on the smooth blade surface without extending from the smooth blade surface more than 0.5 percent of a blade depth.

8. The bidirectional stabilizer of claim 1, comprising a communication conduit for flowing well fluid in the same direction as fluid flowing in the annulus.

9. The bidirectional stabilizer of claim 8, comprising a communication wire disposed in the communication conduit.

10. The bidirectional stabilizer of claim 1, comprising at least one nozzle diverting a portion of drilling fluid from the annulus to the plurality of flutes, the at least one nozzle oriented at an angle from 0 degrees to 90 degrees from the longitudinal axis.

11. A bidirectional stabilizer for use in a wellbore comprising:

a) a shaft centered around a longitudinal axis;

b) an annulus formed longitudinally through the shaft, wherein the annulus is configured for maximum wellbore fluid flow; and c) a cutting portion formed on an outer surface of the shaft, the cutting portion comprising:

i) a first cutting portion extending at a first cutting angle to a first apex from a first shaft end;

ii) a second cutting portion extending at a second cutting angle to a second apex from the second shaft end, the second cutting portion forming a slightly larger outer diameter as the second cutting portion extends away from the second shaft end, wherein the first cutting portion and the second cutting portion are installed at the first cutting angle and the second cutting angles ranging from 20 degrees to 55 degrees from the longitudinal axis of the bidirectional stabilizer;

iii) a plurality of blades integrally connected between the first cutting portion and the second cutting portion, each blade having an identical length, each blade comprising a smooth blade surface with a wrap angle forming a particle flow path between pairs of blades without intersecting more than thirty percent of any one blade and configured with a line of sight parallel to the longitudinal axis;

iv) an outer radius of the cutting portion greater than or equal to ¼ of an inch of a blade depth as measured from a flute trough to reduce hang-up in a wellbore;

v) an inner radius of the cutting portion greater than or equal to ⅛ of an inch of the blade depth as measured from the flute trough to reduce stress on a bottom hole assembly of a drill string to which the bidirectional stabilizer is secured;

vi) a plurality of flutes formed between pairs of blades, the plurality of flutes configured with a first bypass area greater than or equal to thirty-five percent of a bit diameter for bits having an outer diameter of 10 and $\frac{5}{8}^{th}$ inches or greater or a second bypass area greater than or equal to twenty-five percent of a bit diameter for bits having an outer diameter less than 10 and ⅝ inches;

vii) a plurality of cutting nodes installed on at least a portion of at least one edge of the first cutting portion, on at least a portion of at least one edge of the second cutting portion, or on at least a portion of at least one edge of the first cutting portion and the second cutting portion; and viii) a plurality of impact arrestors mounted in a location either directly adjacent each cutting node on the first cutting portion, directly adjacent each cutting node on the second cutting portion, or in both locations; and wherein the bidirectional stabilizer couples on an end portion to the drill string and on a nose portion to the bottom hole assembly simultaneously with the bidirectional stabilizer having a symmetrical configuration.

12. The bidirectional stabilizer of claim 11, wherein the plurality of impact arrestors comprises at least one of: a tungsten carbide arrestor, a ceramic impact arrestor, a polycrystalline diamond impact arrestor, and a diamond impregnated impact arrestor.

13. The bidirectional stabilizer of claim 11, comprising a plurality of cutting inserts, wherein the plurality of cutting inserts comprises at least one of: a diamond impregnated cutting insert and a polycrystalline diamond cutting insert, and wherein the plurality of cutting inserts are mounted either directly on a face of the plurality of blades or on at least one edge of the plurality of blades.

14. The bidirectional stabilizer of claim 11, comprising at least one diamond enhanced hardfacing disposed on at least one of: a portion of each blade, an entire blade, and an area surrounding each impact arrestor.

15. The bidirectional stabilizer of claim 11, comprising from 1 impact arrestor to 60 impact arrestors per bidirectional stabilizer, each impact arrestor configured to simultaneously perform as a shock dampener and as a cutting insert.

16. The bidirectional stabilizer of claim 11, wherein each impact arrestor is either flush mounted in the cutting portion or slightly raised above a surface of the cutting portion or the plurality of blades and extend from the surface less than the plurality of cutting nodes extend from the surface.

17. The bidirectional stabilizer of claim 11, further comprising a plurality of cutting inserts mounted on at least one of: an edge of each blade, cutting portions adjacent the plurality of cutting nodes, and a surface of each blade and wherein the plurality of cutting inserts are disposed on the smooth blade surface without extending from the smooth blade surface more than 0.5 percent of a blade depth.

18. The bidirectional stabilizer of claim 11, comprising a communication conduit for flowing well fluid in the same direction as fluid flowing in the annulus.

19. The bidirectional stabilizer of claim 18, comprising a communication wire disposed in the communication conduit.

20. The bidirectional stabilizer of claim 11, comprising at least one nozzle diverting a portion of drilling fluid from the annulus to the plurality of flutes, the at least one nozzle oriented at an angle from 0 degrees to 90 degrees from the longitudinal axis.

* * * * *